US012781434B2

(12) United States Patent
Eberhardt

(10) Patent No.: US 12,781,434 B2
(45) Date of Patent: Nov. 3, 2026

(54) CLOTHING AND METHOD

(71) Applicant: VOITH PATENT GMBH, Heidenheim (DE)

(72) Inventor: Robert Eberhardt, Ellwangen (DE)

(73) Assignee: Voith Patent GmbH, Heidenheim (DE)

( * ) Notice: Subject to any disclaimer, the term of this patent is extended or adjusted under 35 U.S.C. 154(b) by 159 days.

(21) Appl. No.: 18/654,230

(22) Filed: May 3, 2024

(65) Prior Publication Data

US 2024/0360625 A1 Oct. 31, 2024

Related U.S. Application Data

(63) Continuation of application No. PCT/EP2022/076520, filed on Sep. 23, 2022.

(30) Foreign Application Priority Data

Nov. 4, 2021 (DE) ..... 10 2021 128 660.3

(51) Int. Cl.

| | |
|---|---|
| ***D21F 7/10*** | (2006.01) |
| ***A41H 43/00*** | (2006.01) |
| ***D21F 1/12*** | (2006.01) |
| ***D21F 1/14*** | (2006.01) |
| ***D21F 1/16*** | (2006.01) |
| ***D21F 7/08*** | (2006.01) |

(52) U.S. Cl.

CPC ..... *D21F 7/10* (2013.01); *A41H 43/00* (2013.01); *D21F 1/12* (2013.01); *D21F 1/14* (2013.01); *D21F 1/16* (2013.01); *D21F 7/08* (2013.01); *D21F 7/083* (2013.01)

(58) Field of Classification Search

CPC ... D21F 1/16; D21F 7/08; D21F 7/083; D21F 7/10; D21F 1/12; D21F 1/14

USPC ..... 162/358, 900–904

See application file for complete search history.

(56) References Cited

U.S. PATENT DOCUMENTS 4,283,454 A * 8/1981 Buchanan ..... B32B 5/26 442/247
4,737,241 A * 4/1988 Gulya ..... D21F 7/083 162/200

(Continued)

FOREIGN PATENT DOCUMENTS

DE 102007004676 A1 7/2008
DE 102019134837 A1 6/2021
EP 0287229 B1 * 4/1993 ..... D21F 1/0036

(Continued)

*Primary Examiner* — Anthony Calandra

(74) *Attorney, Agent, or Firm* — Laurence A. Greenberg; Werner H. Stemer; Ralph E. Locher

(57) ABSTRACT

A clothing or seamed felt for use in a pressing part of a machine for producing a fibrous web includes at least one base structure and at least one staple fiber layer on the base structure. The at least one staple fiber layer is disposed on a side facing the fibrous web. At least one seam zone has seam loops connected to one another by at least one pintle to make the clothing endless. The at least one staple fiber layer is divided in the region of the seam zone by at least one cut, forming a seam flap and a seam wedge. The staple fiber layer has in the region of the seam zone, in both the seam flap and the seam wedge, a quantity of connecting fibers connected to one or more additional staple fibers by welded connections. A method for producing a clothing is also provided.

15 Claims, 1 Drawing Sheet

(56) References Cited

U.S. PATENT DOCUMENTS

| | | | | |
|---|---|---|---|---|
| 12,286,753 | B2 * | 4/2025 | Eberhardt | D21F 7/083 |
| 2023/0013706 | A1 * | 1/2023 | Eberhardt | D21F 7/083 |

FOREIGN PATENT DOCUMENTS

| | | | | |
|---|---|---|---|---|
| EP | 2006444 | A2 | 12/2008 | |
| WO | 2015024718 | A1 | 2/2015 | |
| WO | WO-2021121789 | A1 * | 6/2021 | D21F 7/083 |

* cited by examiner

CLOTHING AND METHOD

FIELD AND BACKGROUND OF THE INVENTION

The invention relates to a clothing, in particular a seamed felt, for use in a pressing part of a machine for producing a fibrous web, wherein the clothing includes at least one base structure and at least one staple fiber layer disposed on the base structure, which at least one staple fiber layer is disposed on a side facing toward the fibrous web, the clothing includes at least one seam zone in which seam loops are connected to one another by at least one pintle in order to make the clothing endless, and the at least one staple fiber layer is divided in the region of the seam zone by at least one cut so as to form a seam flap and a seam wedge. The invention also relates to a method for producing a clothing.

In clothings for paper machines, particularly in press felts, development has already been moving away for some time from endless clothings to seamed clothings. An advantage for the user is that these seamed clothings are easier to install in the machine. In new systems, furthermore, significant construction outlay may be obviated when precautions do not need to be taken for putting on endless clothings.

Seamed felts, in particular, are manufactured with a pintle seam which connects the felt ends in the region of their base woven fabric. A nonwoven layer is applied and stitched onto this base woven fabric, which has thereby been made endless, at least onto the paper side—and often also onto the backing side. Since this is advantageous in terms of production technology, the nonwoven layer is in this case also stitched over the pintle seam.

In order to draw the felt into the paper machine, the seam of the felt must be reopened. This is readily possible in the case of the base woven fabric by removing the pintle. However, the nonwoven layers stitched over the seam need to be separated.

For this purpose, the paper-side nonwoven layer of one felt end is separated by a cut in the region of the pintle from the paper-side nonwoven layer of the other felt end. The cut is introduced, after the stitching over the seam, into the nonwoven which is still closed at this time. This cut may be made perpendicularly, although it is preferentially made slightly obliquely, i.e. preferentially with a deviation of 5-30° from the perpendicular, so that a seam flap and a seam wedge are formed.

After the felt has been drawn in, the pintle seam is reclosed with a pintle, for example in the form of a fiber bundle. The two separated ends of the nonwoven overlays cannot, however, be reclosed to the same extent. At this location, the felt, or the nonwoven overlay, has different properties than the remaining part of the felt. Furthermore, this is also a weak location at which the felt May preferentially be damaged by wear.

In order to increase the wear resistance, it is known from the prior, for example the document DE 10 2019 134 837 A1, to reconnect the seam flap and the seam wedge to one another. For this purpose, DE 10 2019 134 837 A1 uses additional connecting elements.

Nevertheless, the difficulty remains that the seam wedge, and in particular the seam flap, are inherently very susceptible to wear.

SUMMARY OF THE INVENTION

The object of the invention is therefore to propose a seam region for a clothing which is less susceptible to wear in comparison with the prior art, but without detrimentally affecting the permeability of the seam region.

It is a further object of the invention to provide a clothing that is easy to produce and allows easy installation in the machine.

The object is achieved according to the invention by an embodiment and by a method described below.

Further advantageous embodiments of the present invention may be found in the dependent claims.

In respect of the clothing, the object is achieved by a clothing, in particular a seamed felt, for use in a pressing part of a machine for producing a fibrous web, wherein the clothing comprises at least one base structure and at least one staple fiber layer arranged on the base structure, which at least one staple fiber layer is arranged on a side of the base structure facing toward the fibrous web. The base structure may, in particular, be a base woven fabric.

The clothing comprises at least one seam zone in which seam loops are connected to one another by at least one pintle in order to make the clothing endless, the at least one staple fiber layer being divided in the region of the seam zone by at least one cut so as to form a seam flap and a seam wedge.

According to the invention, the at least one staple fiber layer has a quantity of connecting fibers in the region of the seam zone both in the seam flap and in the seam wedge, which are connected to one or more further staple fibers by welded connections.

There are no welded connections between the staple fibers of the seam flap and the staple fibers of the seam wedge.

The connecting fibers of the seam flap are thus connected only to staple fibers of the seam flap, while the connecting fibers of the seam wedge are connected only to staple fibers of the seam wedge, In preferred embodiments, the connecting fibers at least partially absorb light with a wavelength in the NIR range of from 780 [nm] to 3 [μm]. Owing to the fact that the connecting fibers at least partially absorb light with a wavelength in the NIR range of from 780 [nm] to 3 [μm], it is possible for the welding of the staple fibers to be carried out by means of transmission welding, for example laser transmission welding.

Alternatively, this may also be carried out by means of a simultaneous welding method in the staple fiber layer in the seam region. A plurality of laser beams are in this case applied from different directions simultaneously or at short intervals onto the region to be welded, these laser beams having sufficient energy to weld the fibers only at their points of intersection and therefore leading to fusion of material and to materially bonded connections at these locations. Special fiber materials that absorb in a particular wavelength range are not necessarily required for this purpose. The wavelength of the laser is to be tuned to the absorption of the fiber material. The fiber material should thus absorb the light of the laser only partially, i.e. by less than 50%, preferentially by less than 30%.

These methods can be made very gentle, so that the properties of the seam zone, for example the permeability, are not modified by the welding, or are modified only little. This represents an advantage, for example over the ultrasonic welding that is likewise possible in principle.

The welding of the connecting fibers to further staple fibers is also to be distinguished from the use of so-called bico fibers or hot-melt adhesive fibers, which comprise two components, for example a polyamide with a sheath consisting of a copolyamide with a lower melting point. Connections between staple fibers may also be generated with these by heating the felt and fusing the corresponding bico fibers. Such connections correspond more to adhesive bonding or soldering. However, the connections are in this case less strong than the welded connections and relatively rapidly become brittle during use of the felt. With such fibers, or such adhesive connections, therefore, the aim of a high wear resistance cannot be achieved to the same extent as with the aforementioned welded connections.

The connecting fibers as part of the staple fiber layer are likewise configured as staple fibers. They may therefore also be processed readily with the other staple fibers, which do not absorb in the corresponding wavelength range.

A seam zone in the context of this application thus means the region around the pintle seam in which connecting fibers are connected by welded connections to further staple fibers of at least one staple fiber layer.

The seam zone conventionally extends over the entire width of the clothing in the transverse direction of the machine.

The inventors have discovered that, by the welding of staple fibers inside the at least one staple fiber layer around the seam, the inner strength of this portion of the staple fiber layer is significantly increased. This offers several advantages. On the one hand, the cutting to form the seam flap and the seam wedge may be carried out more easily and more precisely with the strengthened seam zone.

The two resulting parts (flap and wedge) are furthermore significantly more resistant to abrasion. The cutting thus generally creates smaller fragments of staple fibers, which can be removed more easily from the nonwoven structure. This risk is at least significantly reduced by the welding of staple fibers to one another, since these fiber fragments are held in the structure of the staple fiber layer no longer only mechanically (for example by interlocking) but also by material bonding.

Furthermore, the seam flap as a whole is significantly more stable geometrically. The seam flap has the shape of a triangle—more or less acutely pointed depending on the cutting angle. The front triangle vertex is usually a weak point and may be bent away from the surface of the clothing by the various types of loads in the paper machine. By the welding of the nonwoven fibers in the seam zone, this vertex is stiffened and the risk of bending is reduced.

Such a stiffened seam zone also facilitates installation of the clothing in the machine.

Owing to the fact that there are no welded connections between the seam flap and the seam wedge, it is possible for the seam to be opened again if necessary.

In particular, the connecting fibers may have the same fiber titer as the rest of the staple fibers, or some of the rest of the staple fibers of the staple fiber layer.

The staple fibers that are not connecting fibers may advantageously consist of a polyamide—for example a PA 6 or PA 6.6. Such polyamides are advantageous since they are fully or substantially transparent especially for light with a wavelength in the NIR range of from 780 [nm] to 3 [μm]. It is therefore readily possible to use NIR transmission welding.

It is particularly advantageous for the connecting fibers to consist of the same polymer, in particular a polyamide, as the rest of the staple fibers. If the welded connection is carried out by means of NIR transmission welding, the connecting fibers may be made at least partially absorbent for light with a wavelength in the NIR range of from 780 [nm] to 3 [μm] by an additive.

An example of a suitable additive for this is carbon black. The connecting fibers blackened in this way still fulfill the advantageous secondary effect that the weld seam can be identified easily as a black or darker transverse strip of the clothing, and is therefore also easy to find in order to open the seam.

Alternatively, instead of the same polymer, the connecting fibers and the rest of the staple fibers may also consist of compatibly weldable polymers.

Advantageously, this seam zone is comparatively short in the longitudinal direction, that is to say in the running direction or machine direction of the clothing.

In some preferred embodiments, the seam zone may extend in the longitudinal direction of the clothing over less than 100 mm, in particular less than 50 mm, preferentially over 30 mm. Seam zones with a length of 10 mm or less may also be provided.

Such short seam zones of less than 100 mm fulfill the intended purpose of stabilizing the staple fiber layer in the region of the seam flap and the seam wedge. Furthermore, a short seam zone is easy to produce.

If the welding of the connecting fibers is carried out for example by means of laser transmission welding, it is advantageous if the seam zone can be produced with one or a few passes of the laser head.

Conventional laser optics have a width of for example 30 mm. A 30 mm long seam zone may therefore be produced with a single run of the laser head over the width of the clothing.

Although a particularly long seam zone of more than 10 cm, in particular 50 cm, 100 cm or more, is possible in the context of this invention, the additional length does not offer any great further advantages for the durability of the seam zone, so that the additional outlay for the welding does not need to be expended.

It is moreover possible for the staple fiber layer also to contain connecting fibers outside the seam zone, which are then not welded. This may appear to be expedient for reasons of production technology. Advantageously, however, the proportion of connecting fibers in the staple fiber layer is less outside the seam zone than in the seam zone. Preferentially, no connecting fibers are provided in the staple fiber layer outside the seam zone.

It may prove advantageous for the proportion of connecting fibers that at least partially absorb light with a wavelength in the NIR range of from 780 [nm] to 3 [μm] in the seam zone with respect to the at least one staple fiber layer to be between 5 wt % and 40 wt %, in particular between 15 wt % and 30 wt %.

In the clothings, in particular felts, according to various aspects of the present invention, at least one further staple fiber layer that is arranged on the staple fiber layer may also be provided. Such a further staple fiber layer may, in particular, provide the upper side of the clothing, which touches the paper, and have no connecting fibers.

The surface of the seam zone in this way has an almost identical surface condition as the remaining part of the clothing.

In respect of the method, the object is achieved by a method for producing a clothing according to one aspect of the invention, comprising the steps:

a. providing a base structure and making the latter endless by feeding a pintle into seam loops interleaved in one another
b. arranging a staple fiber layer on a side of the base structure facing toward the fibrous web, the staple fiber layer having a quantity of connecting fibers, which preferably at least partially absorb light with a wavelength in the NIR range of from 780 [nm] to 3 [μm], in the region of the seam loops c. stitching the at least one staple fiber layer to the base structure d. welding connecting fibers to the further staple fibers so as to form a seam zone e. cutting the seam zone so as to form a seam flap and a seam wedge.

In the method described here, there is in particular no method step that generates a welded connection between the staple fibers of the seam flap and the staple fibers of the seam wedge.

If e.) is carried out after d.), this has the advantage that the cutting can be carried out more easily and more precisely. It also avoids undesired welded connections unintentionally being created between the seam flap and the seam wedge by subsequent welding.

There may nevertheless also be applications in which step e.) is carried out before step d.).

The intensity of the laser radiation is to be adapted to the material composite and the intensity of the desired welding and the structural integrity. Advantageously, pressure may also be applied to the seam region during the welding. For example, this may be carried out by NIR transmission welding with a Novolas NIR laser having a roller optic from the company Leister with a wavelength of 840 nm. A roller width of 30 mm may be used. The seam region is processed in this exemplary embodiment at 5 m/min and with a laser power of 450 W and a roller application pressure of 15 N.

In particular, an advantage of the present invention over the prior art is also exhibited in the production method. For instance, in the clothings described in DE 10 2019 134 837 A1, it is necessary to carry out a welding process when the clothing is already installed in the machine. Comprehensive safety precautions must be taken for such a welding process, especially when laser welding is used.

In the method described here, step d) may readily be carried out at the manufacturer, where the clothing can be processed on a specially configured and safeguarded welding station. The cutting of the seam zone may also readily be carried out at the manufacturer.

The clothing may be put onto the machine after the pintle seam has been opened, and then made endless by reclosing the pintle seam. Since there are no welded connections between the seam flap and the seam wedge, no welding process is required on the production machine.

The seam zone according to some aspects of the present invention may in principle be combined with various measures known from the prior art in order to further improve the wear resistance.

For example—in variants not currently being claimed—at least one connecting element may be inserted between the seam flap and the seam wedge, the at least one connecting element being materially connected, in particular welded, to staple fibers of the seam flap and/or of the seam wedge.

Such connecting elements are described, for example, in DE 10 2019 134 837 A1.

In this case as well, the at least one connecting element may comprise a polymer material that at least partially absorbs light with a wavelength in the NIR range of from 780 [nm] to 3 [μm].

Such a connecting element may absorb light in the same wavelength range as the connecting fibers of the at least one staple fiber layer.

It may, however, also be advantageous for such a connecting element to absorb a different part of the NIR range. Even when using the same polymers (for example polyamides), this may for example be achieved by adding different additives. An advantage of this is that the welding of the connecting elements (for example by means of transmission welding) does not have, or has only minor, disadvantageous effects on the staple fiber layer since it is carried out at a different wavelength.

The at least one connecting element is preferentially configured as a thread-shaped or band-shaped connecting element.

Although providing such a connecting element loses the advantages-particularly in terms of production technology-offered by the absence of welded connections between the seam flap and the seam wedge, in special applications the further increased wear resistance of the seam region may however outweigh this disadvantage.

EXAMPLE

The following example will describe a typical felt according to one aspect of the invention as well as steps for its production. The invention is not restricted to this example. It is also clear to a person skilled in the art that the individual aspects of the example (staple fibers, absorbers, method steps, etc.) may also advantageously be used independently of the combination of this example in the context of the invention.

PA6 staple fibers of 44 dtex with an absorption at 940 nm of >80% are mixed as connecting fibers with PA6 staple fibers of 44 dtex in the ratio 30:70. The mixture is carded and a staple fiber layer of 150 g/m$^2$ is produced (nonwoven X).

The following may for example be used as absorbers: finely dispersed absorber powders coextruded with polyamide, for example carbon black powder (generally 0.25-2 wt %) or known inorganic absorber powder, for example $LaB_6$ (generally 0.15-0.75 wt %).

An exemplary felt is produced with a woven base structure.

On the paper side, a series of further staple fiber layers are also provided.

A first further staple fiber layer with 150 g/m$^2$ PA 6.6 fibers of 44 dtex

"Nonwoven X" staple fiber layer is then arranged on this first further staple fiber layer A second further staple fiber layer with 150 g/m$^2$ PA6 fibers of 22 dtex is arranged on this staple fiber layer And a third further staple fiber layer with PA6 fibers of 6.7 dtex thereon A fourth further staple fiber layer with 150 g/m$^2$ PA6 fibers of 22 dtex may be provided on the backing side of the base structure.

The example shows that the staple fiber layer with the connecting fibers, which is important according to some aspects of this invention, makes up only a part, and in this case even less than half, of the paper-side nonwoven overlay of the felt.

The production may be carried out by a usual procedure known to a person skilled in the art, in which the various staple fiber layers are applied successively and are respectively fixed on the base structure successively by stitching. After all the staple fiber layers have been fixed by stitching, a plurality of intense stitching circuits are carried out. The seam zone is subsequently treated over the seam (in each case 15 mm before and after the seam, together 30 mm) with an NIR laser (Leister Novolas Basic AT with roller optic, 940 nm wavelength) at an application pressure of 15 N, a processing speed of 5 m/min and a laser power of 450 watts. Welded fiber-fiber connections are thereby generated in the seam zone, it being possible to partially or completely melt some connecting fibers and generate connecting points between a multiplicity of fibers as a solder.

This is preferentially also followed by a process of thermosetting the entire seam felt. The pintle installed for the thermosetting process is then removed and the welded fiber overlay is cut along the seam. A detailed procedure for the individual steps is known to a person skilled in the art of press felt production.

The invention will be further explained below with the aid of figures. The invention is not restricted to these embodiments.

DETAILED DESCRIPTION OF THE INVENTION

Figure 1:
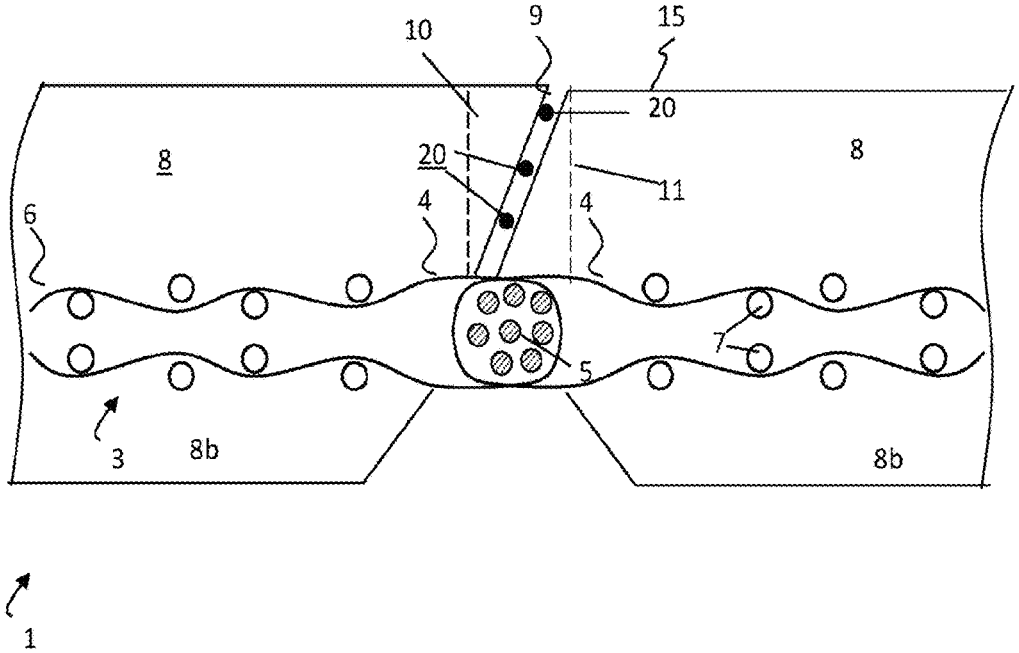
Fig. 1 (Prior Art)
FIG. 1 shows a detail of a clothing according to the prior art.

FIG. 1 shows a detail of a clothing 1 known from the prior art. The clothing comprises a base structure 3, which is configured as a base woven fabric 3. The respective ends of the base structure each have a seam loop 4. Such seam loops 4 may, for example, be formed by folding and superimposing the base structure 3. The seam loops 4 are formed by the longitudinal yarns 6 (MD yarns) of the base woven fabric 3. In order to form the seam loops 4, individual transverse yarns (CD yarns) of the base woven fabric may also be removed. The clothing 1 is made endless by the two seam loops 4 being interleaved with one another and by feeding in a pintle 5. The pintle 5 may in this case be a single filament. The clothing 1 in FIG. 1 shows, as an alternative, a pintle 5 which is formed by a plurality of filaments. When selecting the suitable pintle 5, a person skilled in the art is in other regards substantially free. The advantages of the present invention may be achieved independently of the selection of the pintle 5.

The clothing 1 furthermore comprises a staple fiber layer 8 and a further staple fiber layer 8*b*. The staple fiber layer 8*b* on the backing side may optionally also be omitted. The staple fiber layer 8 on the paper side is applied, in particular stitched, continuously on the base structure 3. In order to be able to open the clothing 1 for drawing into the machine, the staple fiber layer 8 has been opened over the seam by a cut 9. This cut 9 may in principle be made perpendicularly. Conventionally however, as shown in FIG. 1, the cut 9 is made obliquely, that is to say with a certain angle with respect to the perpendicular. This angle is advantageously between 5° and 30°. A seam flap 10 and a seam wedge 11 are thereby formed. The seam flap 10 overlaps the seam wedge 11 in the closed clothing 1.

In the embodiment according to FIG. 1, by way of example three connecting elements 20 are now inserted in the cut. These connecting elements 20 are respectively configured as threads which extend over the entire transverse direction of the clothing 1, or of the cut 9. For example, monofilaments, multifilament bundles or twines may be used as the threads 20. More or fewer than the 3 threads 20 shown may also be used.

The connecting elements 20 may be distributed uniformly over the height of the cut 9. Alternatively, a nonuniform distribution may also be advantageous, for example in such a way that more connecting elements 20 are arranged in the vicinity of the base structure 3 than in the direction of the paper side, or vice versa.

Figure 2:
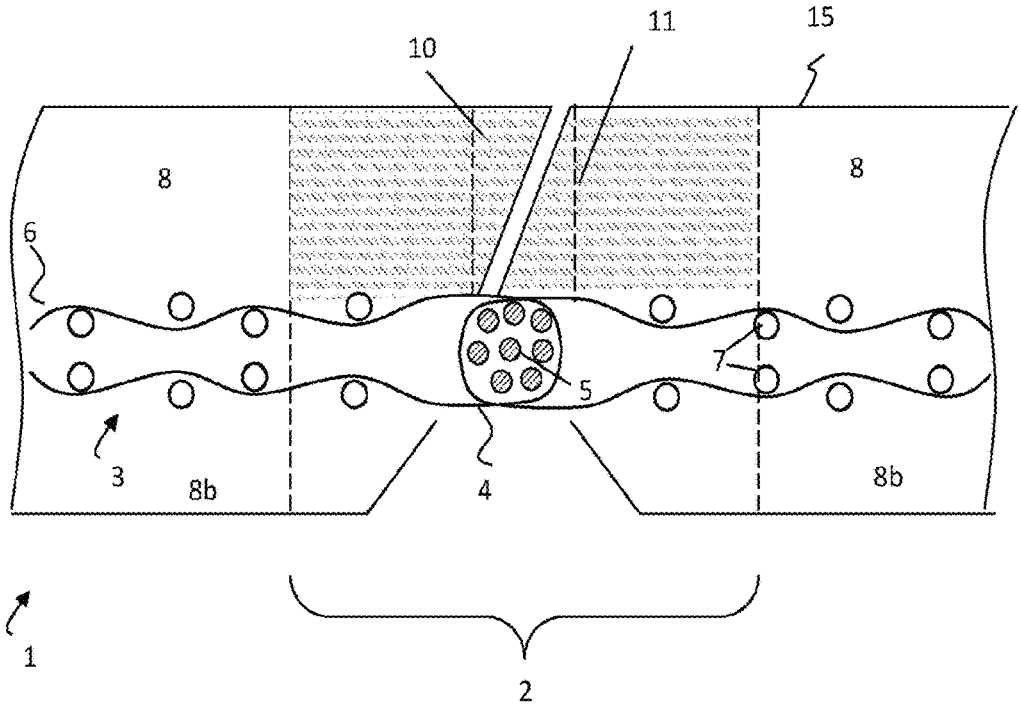
FIG. 2 shows a detail of a clothing according to one aspect of the invention

FIG. 2 shows a clothing 1 according to one aspect of the present invention. In contrast to the clothing 1 shown in FIG. 1, connecting fibers that at least partially absorb light with a wavelength in the NIR range of from 780 [nm] to 3 [μm] are provided in a seam zone 2 in the staple fiber layer 8, and are connected to one or more further staple fibers by welded connections.

The seam zone 2 extends over a certain length before and after the seam loop 4 and comprises both the seam flap 10 and the seam wedge 11.

In some preferred embodiments, the seam zone 2 may extend in the longitudinal direction of the clothing 1 over less than 100 mm, in particular less than 50 mm, preferentially over 30 mm. Such short seam zones 2 fulfill the intended purpose of stabilizing the staple fiber layer 8 in the region of the seam flap 10 and the seam wedge 11. Furthermore, a short seam zone is easy to produce.

The connecting elements 20 shown in FIG. 1 are not provided in the embodiment according to FIG. 2. In alternative embodiments according to further aspects of the invention, such connecting elements 20 may however be provided.

The further staple fiber layer 8*b* on the backing side of the clothing 1 may also be omitted in other embodiments of the invention.

Alternatively or in addition, a further staple fiber layer 8*b* may also be arranged on the staple fiber layer 8 and provide the upper side of the clothing 1, which touches the paper. Such a further staple fiber layer 8*b* usually has no connecting fibers, or at least no connecting fibers that are connected to one or more further staple fibers by welded connections. It is, however, also possible that individual connecting fibers of the staple fiber layer 8 penetrate fully or partially into the further staple fiber layer 8*b* owing to the stitching process, and isolated welded connections to further staple fibers are also generated there.

As shown in the context of the exemplary example, the staple fiber layer 8 with the connecting fibers may make up only a part, and even less than half, of the paper-side nonwoven overlay of the felt 1.

LIST OF REFERENCE SIGNS

1 clothing
2 seam zone
3 base structure
4 seam loops
5 pintle
6 yarn in longitudinal direction (MD)
7 yarn in transverse direction (CD)
8 staple fiber layer
8*b* further staple fiber layer
9 cut
10 seam flap
11 seam wedge
15 upper side touching the paper
20 connecting element

The invention claimed is:

1. A clothing or seamed felt for use in a pressing part of a machine for producing a fibrous web, the clothing comprising:

at least one base structure;

at least one staple fiber layer disposed on said at least one base structure, said at least one staple fiber layer disposed on a side facing toward the fibrous web;

at least one seam zone having seam loops connected to one another by at least one pintle to make the clothing endless;

said at least one staple fiber layer being divided in a region of said at least one seam zone by at least one cut to form a seam flap and a seam wedge;

said at least one staple fiber layer having a quantity of connecting fibers in said region of said at least one seam zone both in said seam flap and in said seam wedge, said connecting fibers being connected to one or more further staple fibers by welded connections;

said connecting fibers of said seam flap being connected only to staple fibers of said seam flap, and said connecting fibers of said seam wedge being connected only to staple fibers of said seam wedge, there being no welded connections between said staple fibers of said seam flap and said staple fibers of said seam wedge;

a proportion of said connecting fibers at least partially absorbing light with a wavelength in the NIR range of from 780 nm to 3 μm in said seam zone relative to said at least one staple fiber layer, being between 5 wt % and 40 wt %; and said region of said at least seam zone having said staple fibers connected by welded connections extending in a longitudinal direction of the clothing over less than 100 mm.

2. The clothing according to claim 1, wherein there are no connections between said staple fibers of said seam flap and said staple fibers of said seam wedge.

3. The clothing according to claim 1, wherein said region of said seam zone, having said staple fibers connected by welded connections, extend in said longitudinal direction of the clothing over less than 50 mm.

4. The clothing according to claim 1, wherein said region of said seam zone, having said staple fibers connected by welded connections, extend in said longitudinal direction of the clothing over 30 mm.

5. The clothing according to claim 1, wherein said connecting fibers at least partially absorb light with a wavelength in the NIR range of from 780 nm to 3 μm.

6. The clothing according to claim 1, wherein a proportion of said connecting fibers in said at least one staple fiber layer outside of said seam zone is less than in said seam zone.

7. The clothing according to claim 1, wherein no connecting fibers are provided in said at least one staple fiber layer outside of said seam zone.

8. The clothing according to claim 1, wherein said connecting fibers are at least one of:

formed of the same polymer as a remainer of said staple fibers, or made at least partially absorbent for light with a wavelength in a wavelength range in the NIR range of from 780 nm to 3 μm by an additive.

9. The clothing according to claim 8, wherein said polymer is a polyamide.

10. The clothing according to claim 1, which further comprises at least one further staple fiber layer disposed on said at least one staple fiber layer, said at least one further staple fiber layer providing an upper side of the clothing touching the paper, and said at least one further staple fiber layer having no connecting fibers.

11. A method for producing a clothing according to claim 1, the method comprising:

a. providing said at least one base structure and making said at least one base structure endless by feeding a pintle into seam loops interleaved with one another;

b. placing said at least one staple fiber layer on a side of said at least one base structure facing toward the fibrous web, said at least one staple fiber layer having a quantity of connecting fibers in said region of said seam loops;

c. stitching said at least one staple fiber layer to said at least one base structure;

d. welding connecting fibers to remaining staple fibers to form a seam zone;

e. cutting said seam zone to form a seam flap and a seam wedge; and providing a region of said seam zone having said staple fibers connected by welded connections extending in a longitudinal direction of the clothing over less than 100 mm.

12. The method according to claim 11, wherein said connecting fibers at least partially absorb light with a wavelength in the NIR range of from 780 nm to 3 μm.

13. The method according to claim 12, wherein said region of said seam zone having said staple fibers connected by welded connections extends in said longitudinal direction of the clothing over less than 50 mm.

14. The method according to claim 12, wherein said region of said seam zone having said staple fibers connected by welded connections extends in said longitudinal direction of the clothing over 30 mm.

15. A clothing or seamed felt for use in a pressing part of a machine for producing a fibrous web, the clothing comprising:

at least one base structure;

at least one staple fiber layer disposed on said at least one base structure, said at least one staple fiber layer disposed on a side facing toward the fibrous web;

at least one seam zone having seam loops connected to one another by at least one pintle to make the clothing endless;

said at least one staple fiber layer being divided in a region of said at least one seam zone by at least one cut to form a seam flap and a seam wedge;

said at least one staple fiber layer having a quantity of connecting fibers in said region of said at least one seam zone both in said seam flap and in said seam wedge, said connecting fibers being connected to one or more further staple fibers by welded connections;

said connecting fibers of said seam flap being connected only to staple fibers of said seam flap, and said connecting fibers of said seam wedge being connected only to staple fibers of said seam wedge, there being no welded connections between said staple fibers of said seam flap and said staple fibers of said seam wedge;

a proportion of said connecting fibers at least partially absorbing light with a wavelength in the NIR range of from 780 nm to 3 μm in said seam zone relative to said at least one staple fiber layer, being between 15 wt % and 30 wt %; and said region of said at least seam zone having said staple fibers connected by welded connections extending in a longitudinal direction of the clothing over less than 100 mm.

* * * * *